US006446536B1

(12) United States Patent
Lindskog et al.

(10) Patent No.: US 6,446,536 B1
(45) Date of Patent: Sep. 10, 2002

(54) METHOD AND DEVICE FOR HANDLING PROPELLING CHARGES IN FULLY AND SEMI-AUTOMATIC LOADING SYSTEMS FOR ARTILLERY GUNS

(75) Inventors: Lars-Olov Lindskog, Karlskoga; Jörgen Bergmark, Västeras; Björn Lundblad, Karlskoga, all of (SE)

(73) Assignee: Bofors Weapon Systems, AB, Karlskoga (SE)

( * ) Notice: Subject to any disclaimer, the term of this patent is extended or adjusted under 35 U.S.C. 154(b) by 0 days.

(21) Appl. No.: 09/674,921

(22) PCT Filed: Apr. 26, 1999

(86) PCT No.: PCT/SE99/00675

§ 371 (c)(1),
(2), (4) Date: Dec. 27, 2000

(87) PCT Pub. No.: WO99/58921

PCT Pub. Date: Nov. 18, 1999

(30) Foreign Application Priority Data

May 8, 1998 (SE) ..... 9801601

(51) Int. Cl.[7] ..... F41A 9/11; F41A 9/13; F41A 9/16

(52) U.S. Cl. ..... 89/45; 89/46; 89/47

(58) Field of Search ..... 89/45–47

(56) References Cited

U.S. PATENT DOCUMENTS

| | | | | | |
|---|---|---|---|---|---|
| 3,208,350 | A | * | 9/1965 | Robinson | 89/46 |
| 3,306,165 | A | * | 2/1967 | Christiansson | 89/46 |
| 3,747,469 | A | * | 7/1973 | Ashley et al. | 89/45 |
| 3,855,899 | A | * | 12/1974 | Billottet et al. | 89/47 |
| 4,388,854 | A | * | 6/1983 | Dabrowski et al. | 89/46 |
| 4,454,799 | A | * | 6/1984 | Gilvydis | 89/47 |
| 5,048,393 | A | | 9/1991 | Grabner et al. | |
| 5,107,751 | A | | 4/1992 | Grabner | |
| 5,111,730 | A | | 5/1992 | Grabner | |
| 5,111,731 | A | | 5/1992 | Grabner | |
| 5,458,044 | A | * | 10/1995 | Delbos | 89/45 |
| 5,526,730 | A | * | 6/1996 | Zangrando | 89/46 |
| 5,675,114 | A | | 10/1997 | Thebault et al. | |
| 5,728,966 | A | * | 3/1998 | Bobinger et al. | 89/46 |
| 5,837,923 | A | * | 11/1998 | Gay et al. | 89/46 |
| 6,026,729 | A | | 2/2000 | Hallqvist | |
| 6,170,380 | B1 | * | 1/2001 | Bender-Zanoni et al. | 89/45 |
| 6,205,904 | B1 | * | 3/2001 | Boutet et al. | 89/45 |

FOREIGN PATENT DOCUMENTS

| | | |
|---|---|---|
| GB | 1 251 176 | 10/1971 |

* cited by examiner

*Primary Examiner*—Michael J. Carone
*Assistant Examiner*—Lulit Semunegus
(74) *Attorney, Agent, or Firm*—Connolly Bove Lodge & Hutz, LLP

(57) ABSTRACT

A loading system of artillery guns to enable modular charges that are combinable into larger units to be handled in a main magazine with a number of mutually parallel magazine tubes designed to accommodate the modular charges and a retrieval tube whose infeed/outfeed aperture can be docked with the outfeed aperture of any magazine tube. The retrieval tube is used to transfer a selected number of modular charges from the magazine tubes to a loading pendulum used for loading the gun.

15 Claims, 5 Drawing Sheets

Figure 1:
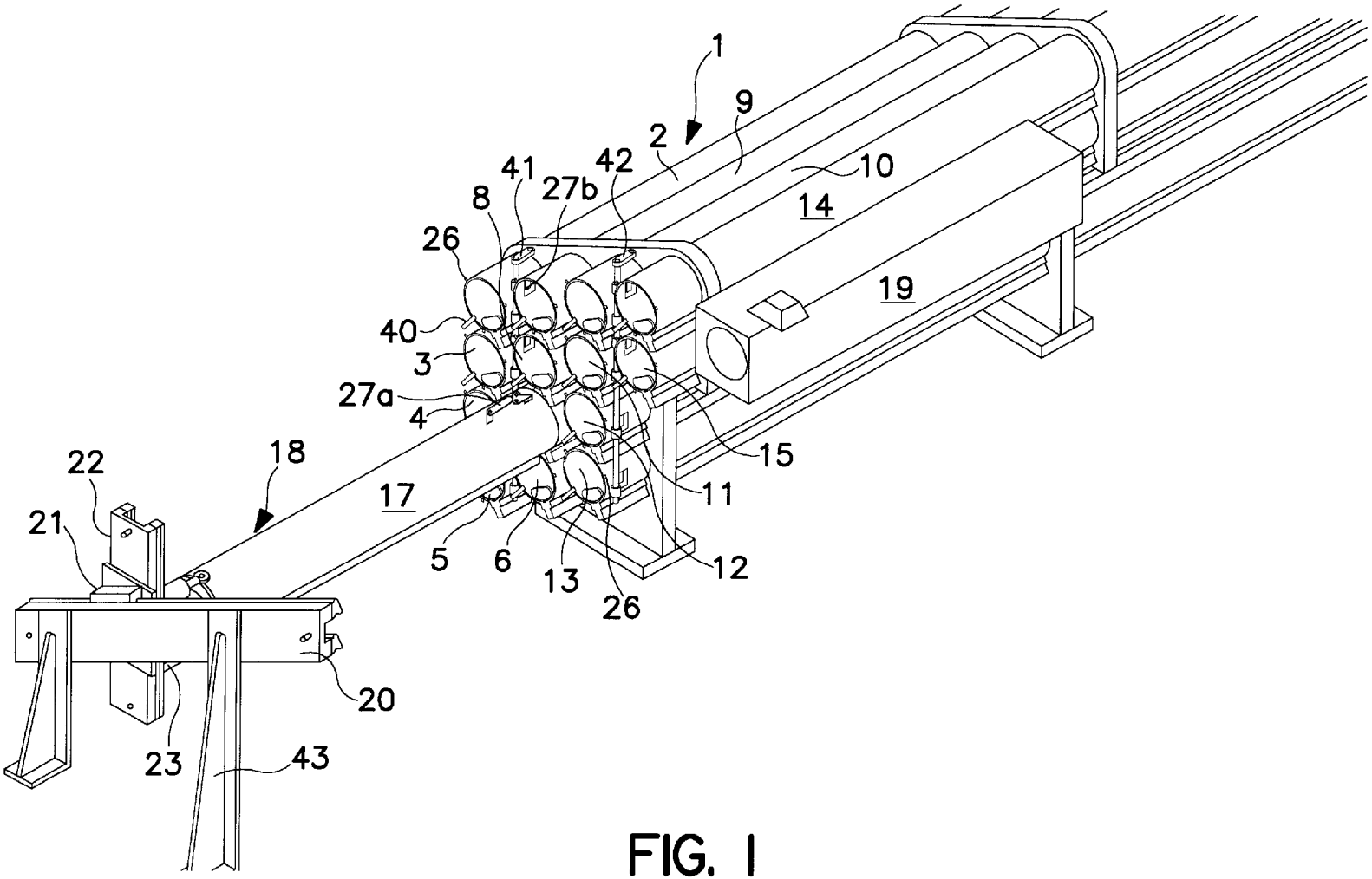

METHOD AND DEVICE FOR HANDLING PROPELLING CHARGES IN FULLY AND SEMI-AUTOMATIC LOADING SYSTEMS FOR ARTILLERY GUNS

The present invention relates to a method and a device for stowing and handling modular propelling charges of modular type in artillery guns with fully or semi-automatic loading systems.

It is already possible using artillery locating radar and other surveillance systems for example, to determine rapidly and with high precision the location of an artillery gun that has opened fire. There is thus a good opportunity for an enemy to open effective counter-battery fire. The artillery has therefore more or less been forced to depart from its previously fairly stationary tactics, in favour of significantly more mobile tactics involving rapid engagements in the form of short intensive fires, followed by immediate redeployment to a pre-determined deployment site at a sufficiently safe distance from the previous one. These new tactics have resulted in an increased need for every gun to be self-propelled and capable of carrying at least a primary requirement of ammunition.

One must also assume that coming generations of artillery will use propelling charges of modular type, i.e. propelling charges consisting of a number of modular charges of different sizes such as length and, to a certain extent, diameter, and of different charge strength with primarily rigid combustible outer casing that are combinable in various ways to provide the desired mule velocities. At present this system of modular charges is called M(A)CS, i.e. Modular (Artillery) Charge System. Moreover, as the next generation of artillery guns is expected to be equipped with armoured protection against battlefield fragments to an even greater extent than is normal today, next generation loading systems will be required to operate very rapidly and be capable of stowing large quantities of propelling charges and of handling all the different types of modular charges in the M(A)CS. The propelling charges must also be stowable in the least possible space. In addition, loading systems shall be robust and durable, and the propelling charge magazine shall be replenishable in a very short time, preferably from a vehicle equipped with an automatic resupply unit.

There is a description of the basic principles for a propelling charge handling system that meets the above requirements in Swedish patent application no. 9604422-7.

This propelling charge handling system is based on the use of a very compact stowage space in which the modular charges are stowed linearly in a number of magazine tubes arranged in parallel with each other, each magazine tube containing modular charges of preferably one and the same type. Each such magazine tube terminates in a common vertical endplane, with each aperture being open for retrieval of the desired number of modular charges from one or more pre-determined magazine tubes. The inside of each such magazine tube is equipped with a controllable outfeed mechanism which ensures that the number of modular propelling charges fed out is always correct. A dedicated manipulator retrieves the selected number of modular charges from the outfeed aperture of the pre-determined magazine tube.

This manipulator can be described as an industrial robot with limited operating motion arranged to manoeuvre a retrieval tube between the outfeed apertures of the magazine tubes. The retrieval tube is thus aligned with the outfeed aperture of a magazine tube after which the desired number of modular charges are transferred to the retrieval tube. This can thus retrieve modular charges from a number of different magazine tubes in succession, and thereby assemble a complete propelling charge of the desired charge strength before it is manoeuvred to an outer end position aligned with the loading pendulum used to load the artillery gun in question and to which the complete charge is transferred by, for example, an ejector built into the retrieval tube. The ejector can also be used to determine the number of modular charges to be retrieved from a specific magazine tube. The pattern of movement of the manipulator involves preferably a parallel displacement of its retrieval tube between different positions in two mutually perpendicular planes so that the retrieval tube is always aligned with the longitudinal axis of the magazine tube with whose outfeed aperture it is docked.

In the Swedish patent application referenced above there are three different methods and devices for manoeuvring the manipulator retrieval tube between the outfeed apertures of the various magazine tubes described above. All three methods and devices satisfy the conditions defined above for manoeuvring the retrieval tube, and as a consequence all three may be used in conjunction with the present invention. However, the best design of the manipulator is probably the one in which the end of the retrieval tube opposite its infeed-outfeed aperture is mounted in one of two guide rails arranged at an angle to each other, one of which defines the vertical motion of the retrieval tube and the other the lateral motion of the retrieval tube, and whose respective carriages travel in parallel planes to each other. each plane being at right angles to the retrieval tube.

The present invention thus relates not to the basic principles for such a loading system but to the practical design of the components incorporated, primarily the magazine tubes and manipulator and the parts incorporated therein, and how they interact with each other. It is essential that this is arranged in such a way that the correct number of modular charges is always transferred from the magazine tubes to the manipulator retrieval tube, and that the functioning of the manipulator is not disturbed by the modular charges which, so to speak, only go half-way between the relevant magazine tube and the retrieval tube. One must remember that this is an ultra-rapid loading system in which the modular charges are moved between the relevant magazine tube and the manipulator retrieval tube at a velocity of several metres per second, and more or less immediately after being deposited in the retrieval tube shall be ready for transfer to the loading pendulum for subsequent ramming in the gun. This latter operation means that from the beginning the modular charges shall be packed close together, end-to-end in the manipulator retrieval tube so that they can be transferred without delay to the loading pendulum, which can then ram them as a single unit into the gun.

To summarise, the present invention can be defined as a detailed design of a device for artillery guns with fully or semi-automatic loading systems for stowing, handling and, prior to loading of the gun in question, preparing propelling charges consisting of a number of combinable modular charges of M(A)CS type that can be of variable propelling strengths depending on size, length, diameter and/or because they contain different types of propellant, but which all have in the main a rigid, combustible outer casing containing the necessary initiation compositions, and which modular charges are freely combinable to enable selection of the appropriate muzzle velocity to provide the desired range and trajectory for the projectile. The device in the present invention also presupposes that the stowage space for the modular charges shall be comprised of a number of mutually parallel magazine tubes arranged above and beside each other, each tube being capable of accommodating a number of modular charges arranged linearly end-to-end, and wherein each such magazine tube terminates in a common vertical endplane with each outfeed aperture being accessible for a retrieval tube that can be manoeuvred step-by-step between the outfeed apertures by a manipulator. The retrieval tube can thereby be aligned with each relevant magazine tube. The manipulator has at least one outer stop position for the retrieval tube in which the retrieval tube is beside the magazine tubes while simultaneously being immediately behind and in alignment with the loading pendulum used to ram the gun in question, and to which loading pendulum the modular charges in the retrieval tube shall be immediately transferred. Each of the magazine tubes is also equipped with an internal outfeed function for feeding out the selected number of modular charges on each occasion.

Furthermore, the manipulator retrieval tube in the present invention incorporates a built-in outfeed device that can be docked with the outfeed device of each magazine tube in such a way that the outfeed device of the retrieval tube reverses at the same rate as the outfeed device of the magazine tube to enable transfer of the modular charges to the retrieval tube. In this way the modular charges are kept packed together, end-to-end while being transferred from the relevant magazine tube to the retrieval tube.

The retrieval tube is also designed in such a way that prior to each transfer of modular charge(s) it reverses a short distance from the magazine tube with which it was previously engaged so that it travels independently to alignment with the next magazine tube from which modular charge(s) is(are) to be retrieved and travels forwards to dock with that magazine tube.

The retrieval tube and the magazine tubes are also fitted with retainers that retain the outermost modular charge in the respective tubes to prevent it from falling out.

The present invention also includes two variants of how one can achieve parallel control of the selected magazine tube and the outfeed device of the retrieval tube. This could thus be enabled by means of interconnectable gears or parallel controlled electric motors.

One method of driving all magazine tube outfeed devices by one and the same electric motor is also described, in which drive is freely selectable solely for the outfeed function of the relevant magazine tube. This solution is based on the principle that the electric motor drives the input shafts for all the magazine tube outfeed devices with a combined electric clutch/brake engaged between these shafts and outfeed devices, whereby the clutch function is actuated at the shaft of the magazine tube outfeed device selected for outfeed while the braking function is simultaneously actuated for the other shafts.

Figure 4:
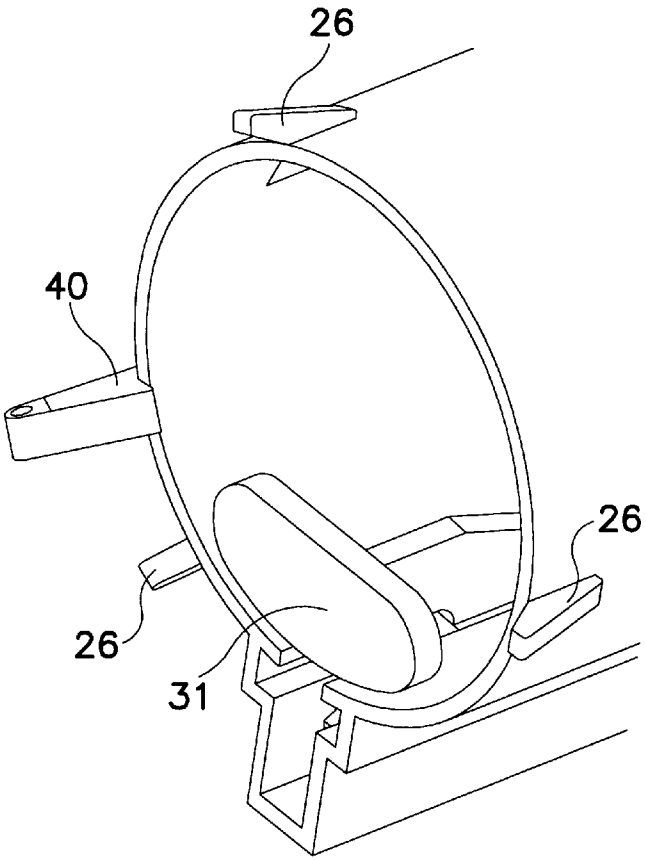
Figure 2:
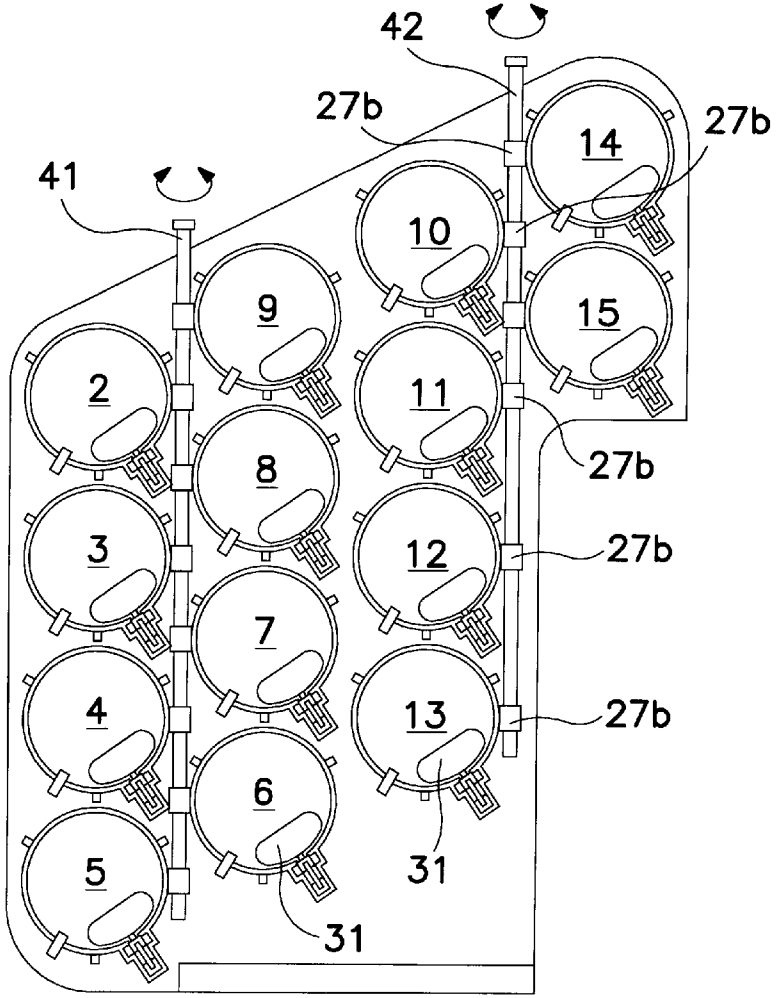
Figure 3:
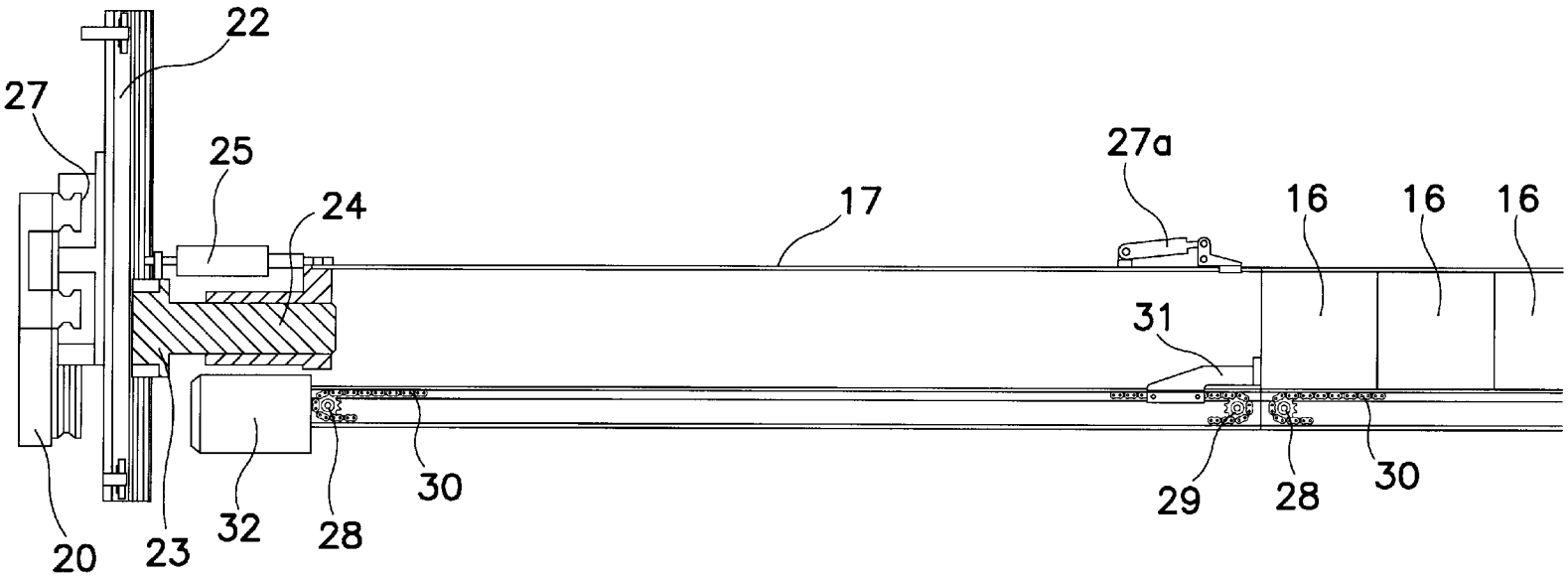
Figure 5:
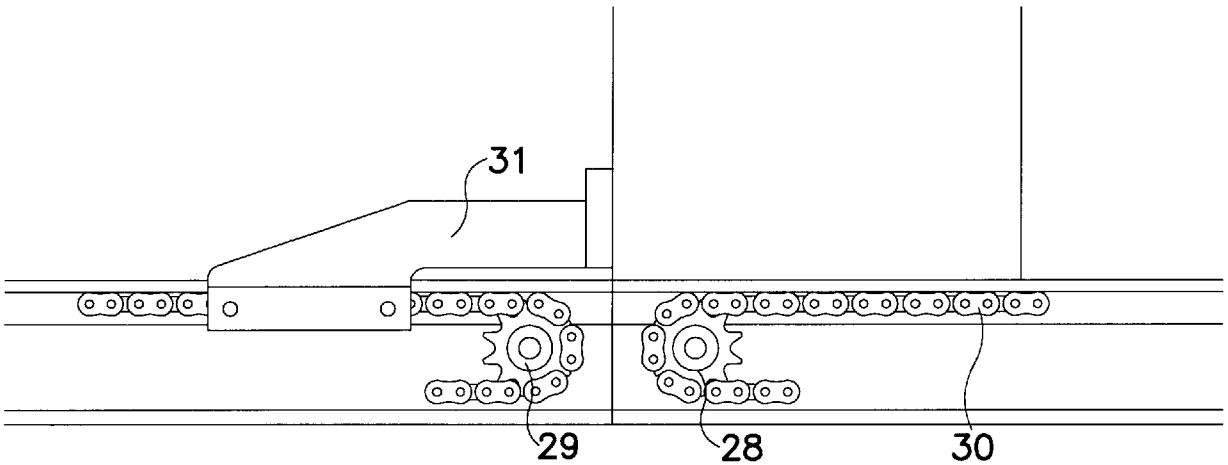
Figure 6:
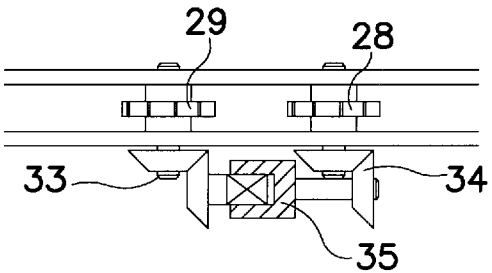
Figure 7:
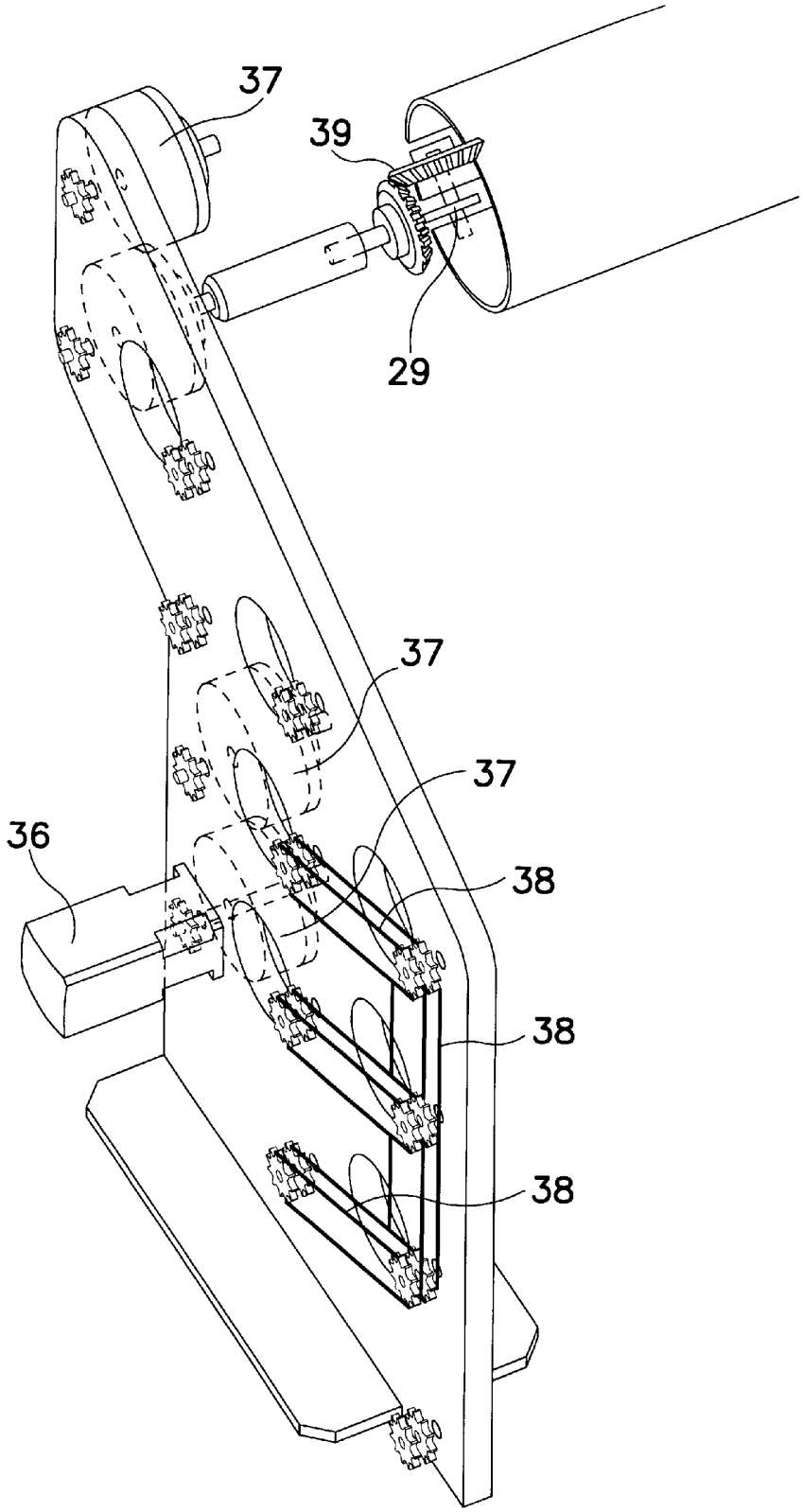

The present invention is defined in the subsequent Patent Claims and shall now be described in further detail with reference to the appended figures in which FIG. 1 shows a diagonal section of the main parts of an ammunition handling system, FIG. 2 shows a longitudinal section to a larger scale of the outfeed apertures of the magazine tubes in the main magazine, FIG. 3 shows a longitudinal section through the retrieval tube of the manipulator, FIG. 4 shows a diagonal section to a larger scale of the outfeed aperture of a magazine tube, FIGS. 5&6 show parts of a variant of a method for a parallel drive for the outfeed devices of the magazine tubes and the retrieval tube, and FIG. 7 shows a system for driving the outfeed devices of all the magazine tubes with one and the same electric motor.

The main magazine 1 shown in FIG. 1 comprises fourteen horizontally fixed magazine tubes 2–15 for propelling charges 16 of modular type. All these magazine tubes 2–15 incorporate chain driven outfeed devices designed in the same way as the complete outfeed device in the retrieval tube 17 incorporated in the manipulator 18 used to retrieve modular charges from one or more of the magazine tubes 2–15 and to deposit the modular charges into the loading pendulum 19 that is used for loading the gun in question. The actual gun has not been illustrated in the figures. The manipulator 18 also incorporates a bracket 43 and a guideway system comprising a diagonal guide rail 20 along which a carriage 21 travels on which a vertical rail 22 is mounted along which a vertical carriage 23 travels.

As illustrated in FIG. 3 the retrieval tube 17 is mounted on the vertical carriage 23. By means of controlled displacement of the two carriages 21 and 23 along guide rails 20 and 22 the retrieval tube 17 can be made to assume a position in direct alignment with any freely selectable magazine tube as well as direct alignment with the input aperture of the loading pendulum 19.

As illustrated in FIG. 3 the retrieval tube 17 is mounted on a shaft 24 along which the retrieval tube 17 has limited longitudinal travel driven by a driver 25. This is to enable the retrieval tube 17 to be reversed after docking with a magazine tube (in FIG. 1 it is magazine tube 7) or the loading pendulum 19, or to be driven forwards to dock with the next magazine tube or the loading pendulum. As illustrated in FIGS. 1 and/or 4 there are guide lugs 26 located around the outfeed aperture of each magazine tube to ensure that the retrieval tube 17 becomes precisely aligned with the selected magazine tube.

Each magazine tube 2–15 and the retrieval tube 17 are also fitted with an actuatable retainer 27*b* and 27*a* respectively (illustrated in FIGS. 2–4) whose task is to retain the outermost modular charge during handling phases when the outermost modular charge is not retained in any other way. This applies to retainer 27*a* on the retrieval tube 17 during all travel phases of the said retrieval tube, i.e. while it reverses from the magazine tube from which it has retrieved modular charge(s) and during diagonal and/or vertical travel to its final position in alignment with the loading pendulum as well as during its forward travel to the loading pendulum or another magazine tube.

On the other hand, the retainer 27*b* on each of the magazine tubes 2–15 need be engaged with the relevant modular charge only during the considerably shorter time that elapses while separating the retrieval tube from the magazine tube in question. The outfeed aperture of each magazine tube 2–15 is namely equipped with a spring-loaded independent retainer 40 whose task is to retain the outermost modular charge 16 when the retrieval tube 17 is not docked with the said magazine tubes.

As illustrated in FIG. 2 the retainers 27*b* of the magazine tubes 2–15 are mounted on two rotatable shafts 41 and 42, each of which is located between two rows of magazine tubes 2–15. By rotating either of these shafts all the retainers in one of the rows are actuated. The direction in which the shaft is rotated determines for which row the retainers are actuated.

There is an outfeed device located in the retrieval tube 17 as well as in each of the magazine tubes 2–15. Each outfeed device comprises an outfeed head 31 attached to and driven by a drive chain 30 that runs around two cogwheels 28 and 29. The chain is in turn driven by an electric motor 32 via a mitre-wheel reduction gear.

The chains are controlled in such a way that when the outfeed device of a magazine tube outfeeds a pre-determined number of modular charges 16 to the retrieval tube 17 with which it is docked, the outfeed device of the retrieval tube reverses at the same rate to enable the modular charges to be fed into the retrieval tube, i.e. the chains 30 are driven in the same direction.

When the modular charges 16 are subsequently transferred to the loading pendulum 19 this is achieved by driving the outfeed device chain of the retrieval tube 17 in the opposite direction.

The parallel control indicated above of the drive chains 30 in the retrieval tube and in the magazine tube with which it is docked can, for example, also be resolved in the way illustrated in FIGS. 5 and 6 in which cogwheels 28 and 29 are connected to mitre-wheel reduction gears 33 and 34 respectively, which gears are interconnected via a coupling 35 that engages when the retrieval tube 17 docks with a magazine tube.

All the drive chains 30 can be driven by one electric motor 32, namely the one incorporated in the manipulator 18.

Of course, the manipulator and each of the magazine tubes have their own electric motors that are electronically controlled in parallel.

Another version is illustrated in FIG. 7 showing the opposite end of the magazine tubes compared with FIG. 1. In this version the retrieval tube 17 has its own electric motor and all the magazine tubes 2–15 have a common electric motor 36 which drives the drive chain 30 of each magazine tube via a number of electronically controlled coupling/brake devices 37. The electric motor 36 is linked via chains 38 to the input shafts of each of the coupling/brake devices 37, while an electronic control device ensures that all the said coupling/brake devices 37 are braked with the exception of the one in the magazine tube from which modular charges are to be retrieved.

As illustrated in FIG. 7 there is a mitre-wheel gear 39 between the output shaft of the coupling/brake device 37 and the actual chain-drive cogwheel 29.

What is claimed is:

1. A loading system for artillery guns for handling modular propelling charges combinable into larger charge units in a main magazine, the loading system comprising: a loading pendulum; a plurality of adjacent magazine tubes that terminate with apertures in a common plane, wherein each magazine tube contains an internally disposed outfeed head; a retrieval tube with an aperture that can dock with the apertures of the magazine tubes, and which contains an internally disposed outfeed head; and a controllable drive mechanism that mutually drives the outfeed head of the magazine tube and the outfeed head of the retrieval tube in the same direction and at the same speed.

2. The loading system of claim 1 wherein the controllable drive mechanism comprises: a drive chain and cogwheels externally disposed in a channel adjacent to each of the plurality of magazine tubes with the drive chain and the cogwheels adjacent the magazine tubes connected in a closed loop arrangement; and a drive chain and cogwheels externally disposed in a channel adjacent to the retrieval tube with the drive chain and the cogwheels adjacent to the retrieval tube connected in a closed loop arrangement, wherein the outfeed heads disposed in the magazine tubes and the outfeed head of the retrieval tube are connected to their respective drives chains by extending through a longitudinal slot in each of the magazine tubes and the retrieval tube, respectively.

3. The loading system of claim 2 wherein each of the magazine tubes includes a drive member with a coupling member that connectively couples with a drive member of the retrieval tube if the aperture of the retrieval tube is docked with the aperture of one of the magazine tubes, and the drive chain (30) of the retrieval tube (17) is connected to an electric motor (32).

4. The loading system of claim 2 wherein the drive chain (30) of the retrieval tube (17) is connected to a first electric motor (32) and a second electric motor (36) is engageable for driving the drive chain of the magazine tube with which the retrieval tube is docked, wherein the first and second electric motors are linked to a control function that enables equidistant movement of the outfeed head of the retrieval tube and the outfeed head of the magazine tube to which the retrieval tube is docked.

5. The loading system of claim 4 wherein the drive chain in each of the magazine tubes includes a drive function which includes an electric coupling/brake device engageable with the drive chain of the magazine tube that is docked with the retrieval tube.

6. The loading system of claim 1 wherein the retrieval tube (17) is axially displaceable in the longitudinal direction from a first reversed transport position that provides a certain gap between the aperture of the retrieval tube (17) and the common plane of the magazine tubes, and a second forward position in which the aperture of the retrieval tube (17) is against the aperture of the magazine tube with which the retrieval tube is docked.

7. A device as claimed in claim 6 wherein the magazine tubes and the retrieval tube (17) include an actuatable retainer (27) that retains the modular charge closest to the outfeed aperture of the magazine tubes and the retrieval tube.

8. A device as claimed in claim 6 wherein each magazine tube further comprises a spring-loaded independent retainer that retains an outermost modular charge (16) in each magazine tube if the retrieval tube (17) is not docked with the magazine tube.

9. The loading system of claim 7 wherein the retrieval tube comprises an actuated retainer to retain an outermost modular charge in the retrieval tube.

10. The loading system of claim 2 wherein the retrieval tube is axially displaceable in the longitudinal direction from a first reversed transport position that provides a certain gap between the aperture of the retrieval tube and the common plane of the magazine tubes, and a second forward position in which the aperture of the retrieval tube is against the aperture of the magazine tube to which the retrieval tube is docked.

11. The loading system of claim 3 wherein the retrieval tube is axially displaceable in the longitudinal direction from a first reversed transport position that provides a certain gap between the aperture of the retrieval tube and the common plane of the magazine tubes, and a second forward position in which the aperture of the retrieval tube is against the aperture of the magazine tube to which the retrieval tube is docked.

12. The loading system of claim 4 wherein the retrieval tube is axially displaceable in the longitudinal direction from a first reversed transport position that provides a certain gap between the aperture of the retrieval tube and the common plane of the magazine tubes, and a second forward position in which the aperture of the retrieval tube is against the aperture of the magazine tube to which the retrieval tube is docked.

13. The loading system of claim 5 wherein the retrieval tube is axially displaceable in the longitudinal direction from a first reversed transport position that provides a certain gap between the aperture of the retrieval tube and the common plane of the magazine tubes, and a second forward position in which the aperture of the retrieval tube is against the aperture of the magazine tube to which the retrieval tube is docked.

14. The loading system of claim 7 wherein the aperture of each magazine tube includes a spring-loaded independent retainer whose task when actuated is to retain the outermost modular charge in each magazine tube with which the retrieval tube is not docked.

15. The loading system of claim 8 wherein the retrieval tube comprises an actuated retainer to retain an outermost modular charge in the retrieval tube.

* * * * *